US005438763A

United States Patent [19]

Yang

[11] Patent Number: 5,438,763

[45] Date of Patent: Aug. 8, 1995

[54] MULTIPURPOSE ELECTRIC DRYER

[76] Inventor: Chiung-hsiang Yang, No. 293, Tien-Chin Road, Sec. 4, Pei-Tun District, Taichung City, Taiwan

[21] Appl. No.: 350,093

[22] Filed: Nov. 29, 1994

[51] Int. Cl.[6] ..... F26B 19/00

[52] U.S. Cl. ..... 34/90; 34/97; 34/621; 34/619; 392/381

[58] Field of Search ..... 34/90, 91, 96, 97, 98, 34/283, 618, 619, 621, 622; 392/380–382, 370, 363

[56] References Cited

U.S. PATENT DOCUMENTS

| | | | |
|---|---|---|---|
| 4,195,416 | 4/1980 | Hall | 34/90 |
| 4,642,909 | 2/1987 | Garcia | 34/97 |
| 4,700,049 | 10/1987 | Rubin | 34/97 |
| 4,735,002 | 4/1988 | Rath | 34/97 |
| 4,858,336 | 8/1989 | Varma | 34/90 |
| 5,177,879 | 1/1993 | Muta | 34/90 |
| 5,351,417 | 10/1994 | Rubin | 34/90 |
| 5,377,424 | 1/1995 | Albanes | 34/90 |

*Primary Examiner*—Denise L. Gromada

*Attorney, Agent, or Firm*—Morton J. Rosenberg; David I. Klein

[57] ABSTRACT

A multipurpose electric dryer including a housing covered with a front cover, a blast fan installed in the housing and having an air output port coupled with a fully clad electric positive-temperature-coefficient heater and connected to a first air hole and a second air hole on the front cover, a sliding hanger moved in a vertical sliding way on the front cover, a hot air hose having one end fixedly connected to the second air hole and an opposite end coupled with an airflow nozzle, a shutter linked to the sliding hanger and moved to alternatively open the air holes, a spring fastened to the front cover to pull the shutter away from the second air hole, wherein when the air-flow nozzle is hung on the sliding hanger, the sliding hanger is downward to pull the shutter rightward, causing the shutter to open the first air hole and close said second air hole, permitting hot air be driven out of a front opening on the front cover for drying the hands; when the air-flow nozzle it removed from the sliding hanger, the spring pulls the shutter leftwards to close the first air hole and open the second air hole, permitting hot air be driven out of the air-flow nozzle of the hot air horse for drying the hair.

4 Claims, 7 Drawing Sheets

MULTIPURPOSE ELECTRIC DRYER

BACKGROUND OF THE INVENTION

The present invention relates to a multipurpose electric dryer for use in a bathroom or toilet for drying the hands as well the hair.

Regular hand dryers for use in bathrooms and toilets are commonly comprised of an electric heating wire of nickel-chrome alloy and a blast fan, and controlled to cause currents of hot air for drying the hands. Using an electric heating wire to produce heat consumes much electric power. When an electric heating wire is heated, it does not produce heat evenly. When an electric hand dryer is used, the hands must be kept away from the air output port at a suitable distance because the temperature of the currents of hot air may be excessively high. Furthermore, regular hand dryers for use in bathrooms and toilets are suitable for drying the hands only.

SUMMARY OF THE INVENTION

The present invention has been accomplished under the circumstances in view. It is one object of the present invention to provide a multipurpose electric dryer which is suitable for drying the hands as well as the hair. It is another object of the present invention to provide a multipurpose electric dryer which uses a fully clad electric positive-temperature-coefficient (PTC) heater to produce heat stably without consuming much electric power.

According to one aspect of the present invention, the multipurpose electric dryer comprises housing covered with a front cover, a blast fan installed in the housing and having an air output port coupled with a fully clad electric positive-temperature-coefficient heater and connected to a first air hole and a second air hole on the front cover, a sliding hanger moved in a vertical sliding way on the front cover, a hot air hose having one end fixedly connected to the second air hole and an opposite end coupled with an air-flow nozzle, a shutter linked to the sliding hanger and moved to alternatively open the air holes, a spring fastened to the front cover to pull the shutter away from the second air hole, wherein when the air-flow nozzle is hung on the sliding hanger, the sliding hanger is downward to pull the shutter rightward, causing the shutter to open the first air hole and close said second air hole, permitting hot air be driven out of a front opening on the front cover for drying the hands; when the air-flow nozzle it removed from the sliding hanger, the spring pulls the shutter leftwards to close the first air hole and open the second air hole, permitting hot air be driven out of the air-flow nozzle of the hot air horse for drying the hair.

According to another aspect of the present invention, the front cover has a towel rack for hanging towels below the front opening.

According to still another aspect of the present invention, a sliding flow guide is mounted on the front opening of the front cover and moved to let hot air be driven out of the front opening of the front cover forward for drying the hands, or downward for drying the towels on the towel rack.

DETAILED DESCRIPTION OF THE PREFERRED EMBODIMENT

Figure 1:
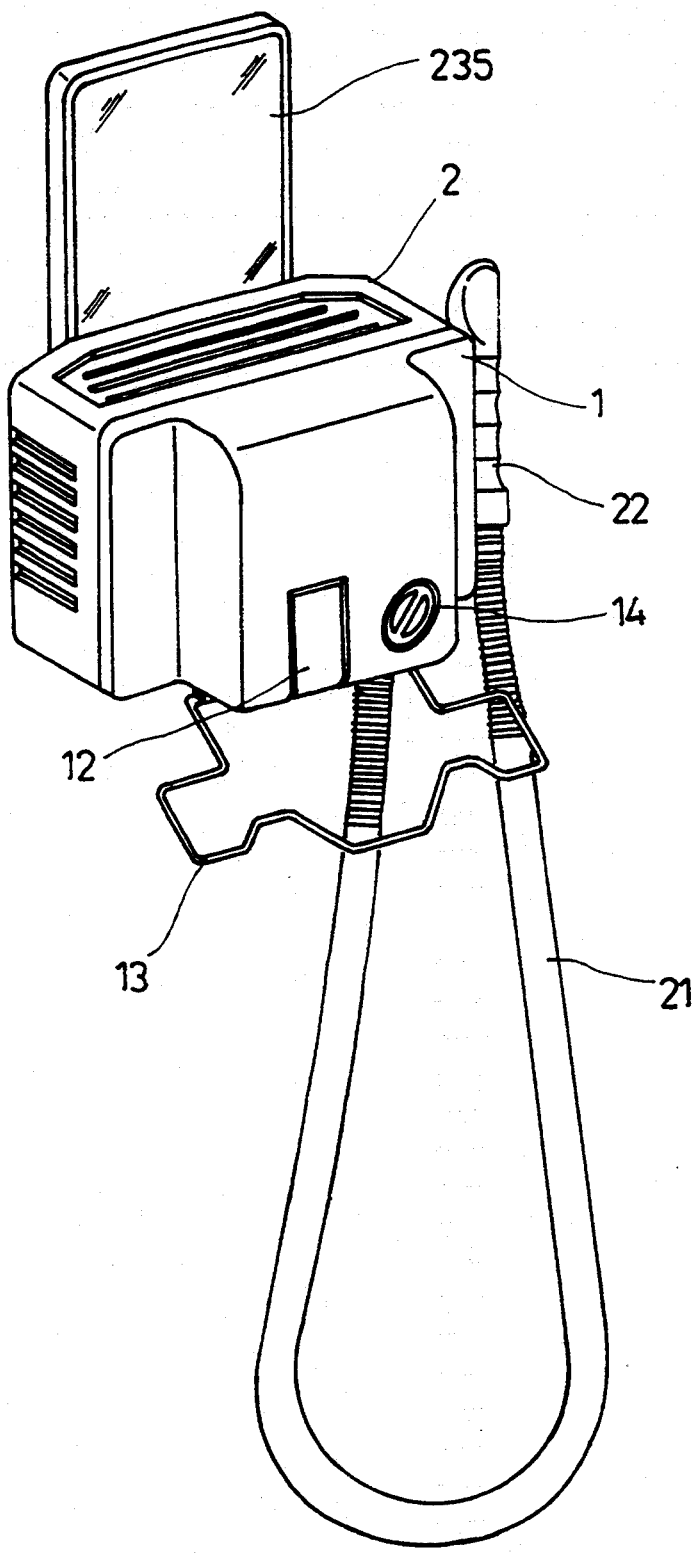
FIG. 1 is an elevational view of a multipurpose electric dryer according to the present invention.
Figure 2:
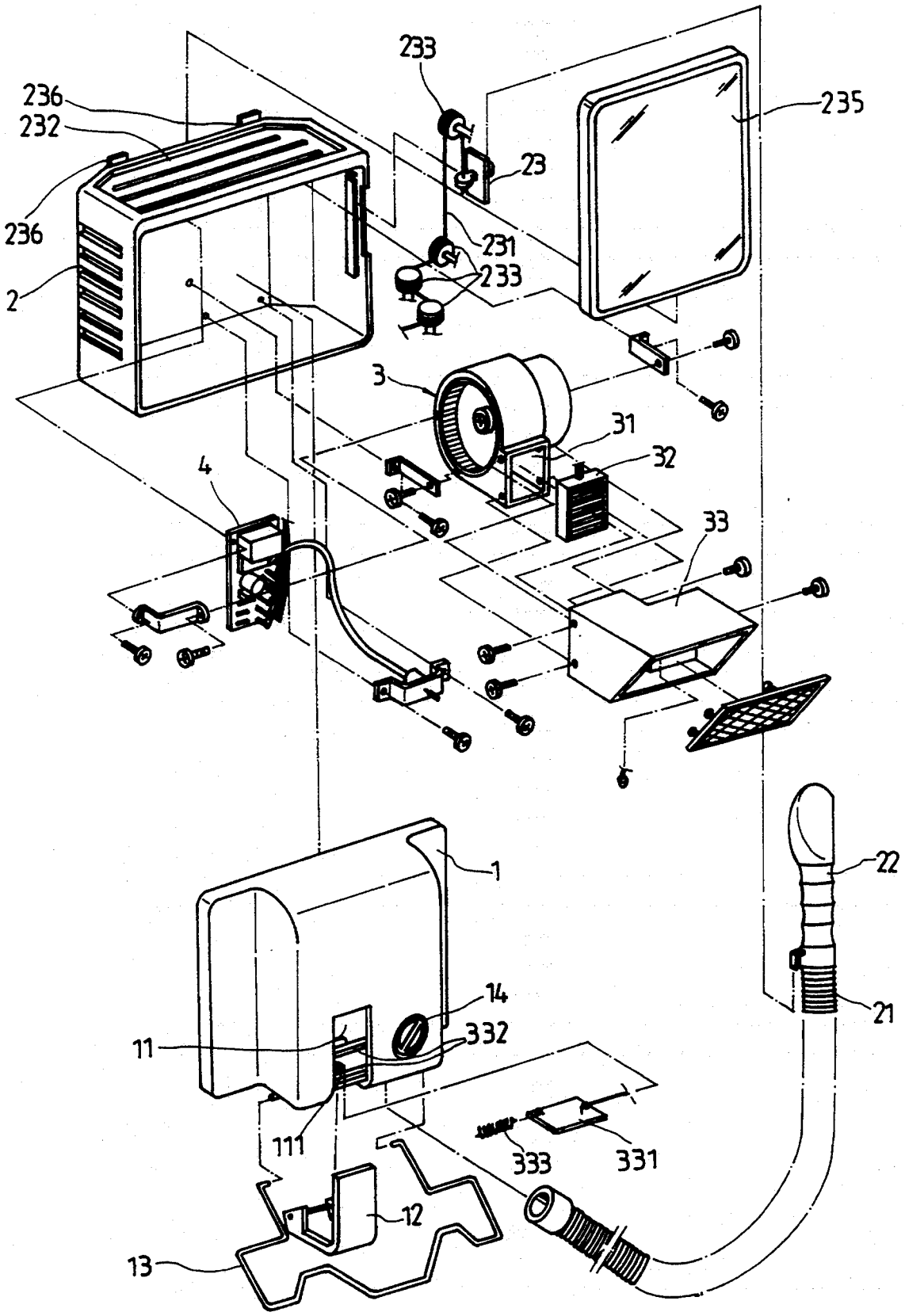
FIG. 2 is an exploded view of the multipurpose electric dryer shown in FIG. 1.
Figure 3:
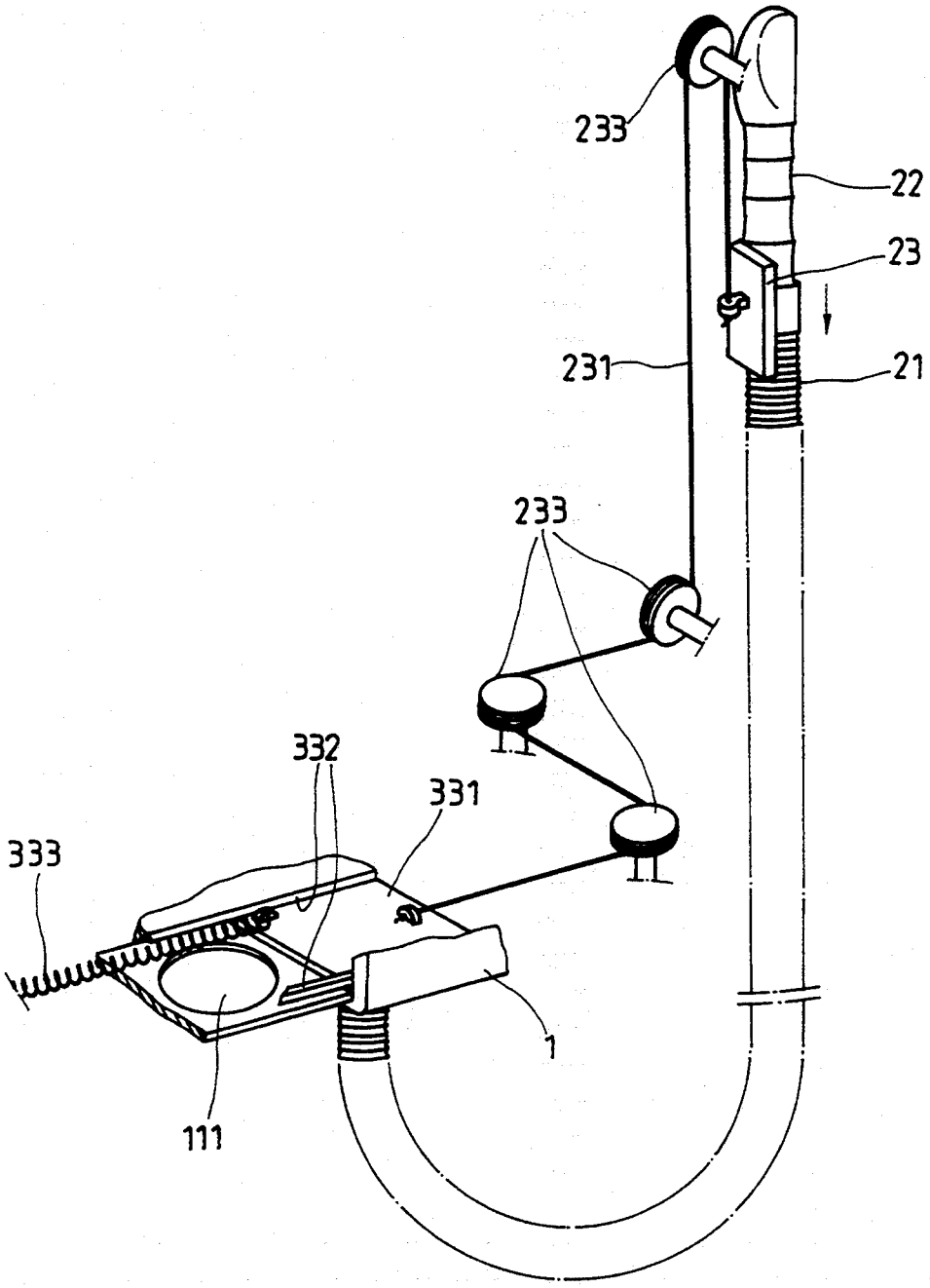
FIG. 3 is a schematic drawing showing the air-flow nozzle removed from the sliding hanger and the shutter moved away from the second air hole according to the present invention.
Figure 4:
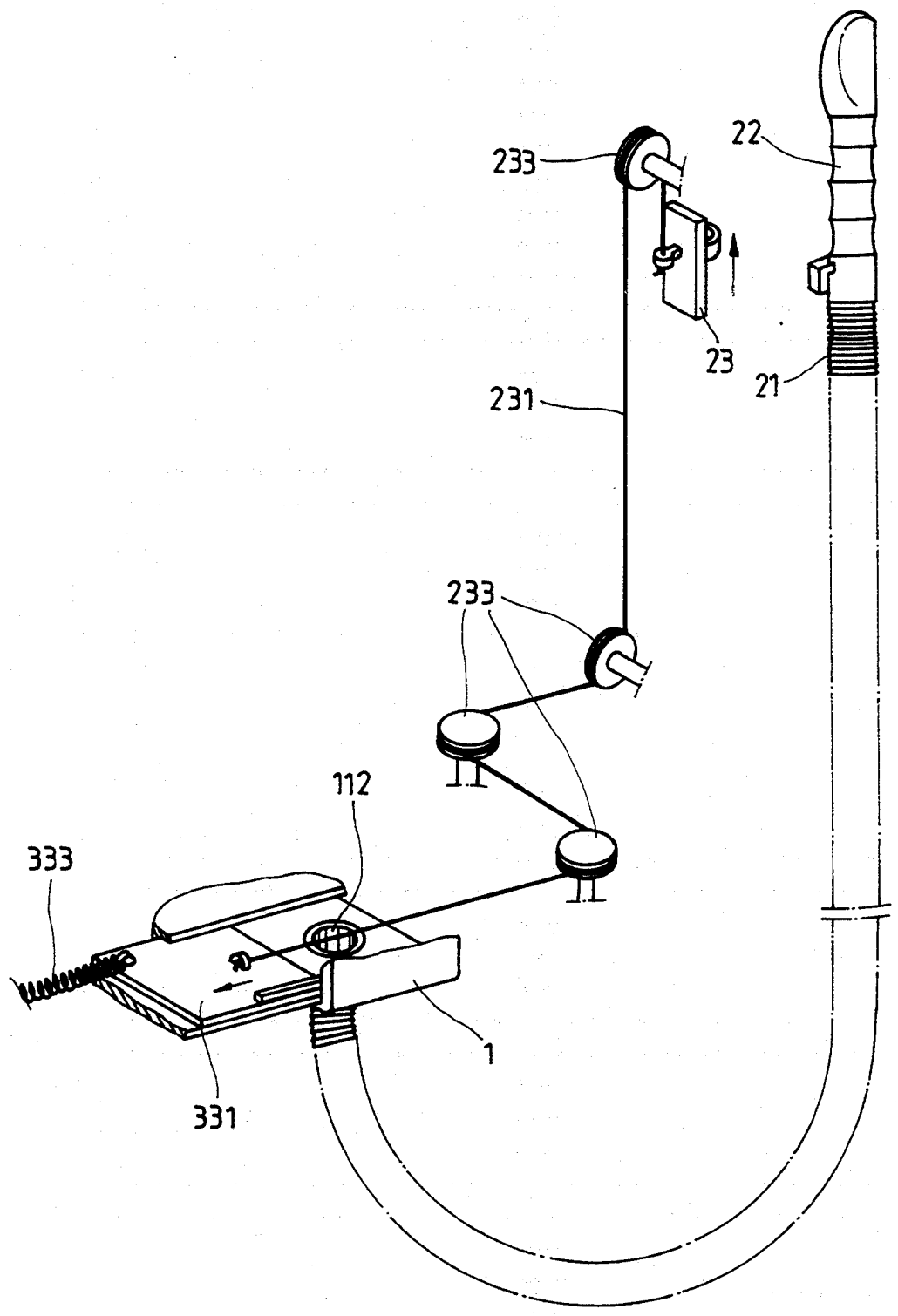
FIG. 4 is similar to FIG. 3 but showing the air-flow nozzle hung on the sliding hanger and the shutter moved away from the first air hole according to the present invention.
Figure 5:
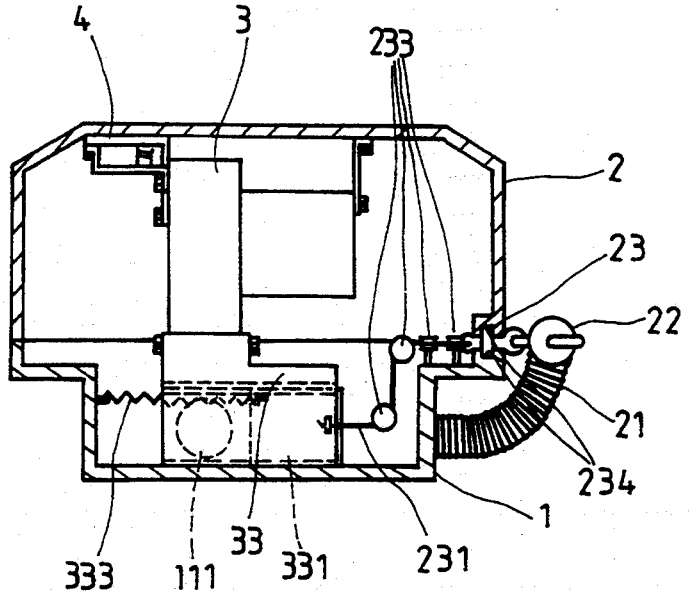
FIG. 5 is a top view in section of the multipurpose electric dryer of FIG. 1, showing the air-flow nozzle hung on the sliding hanger.
Figure 6:
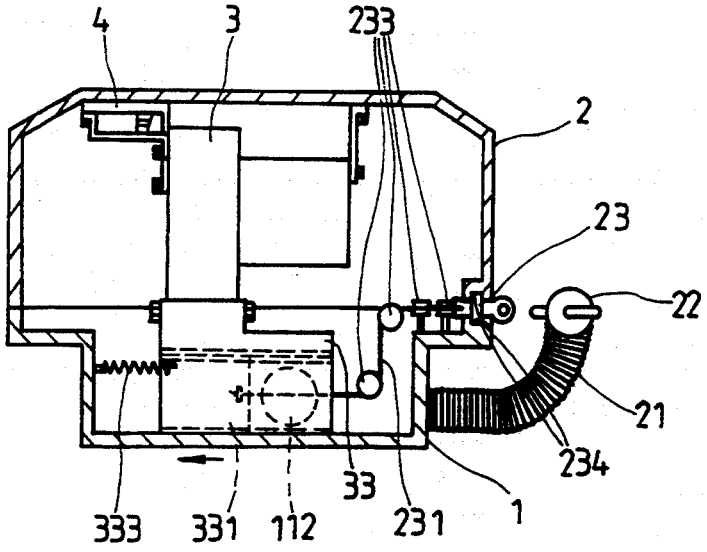
FIG. 6 is similar to FIG. 5 but showing the air-flow nozzle removed from the sliding hanger.
Figure 7:
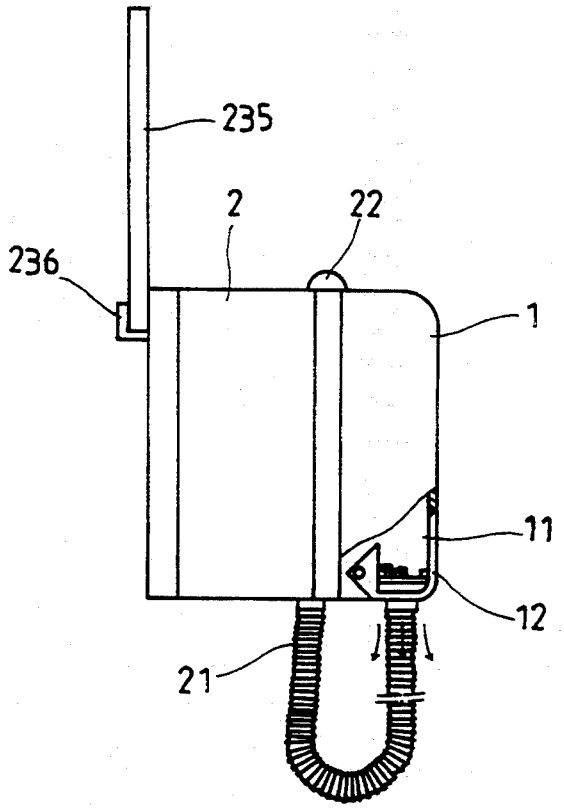
FIG. 7 is a side view in section of the multipurpose electric dryer of FIG. 1, showing currents of hot air driven out of the front opening of the front cover downward.
Figure 8:
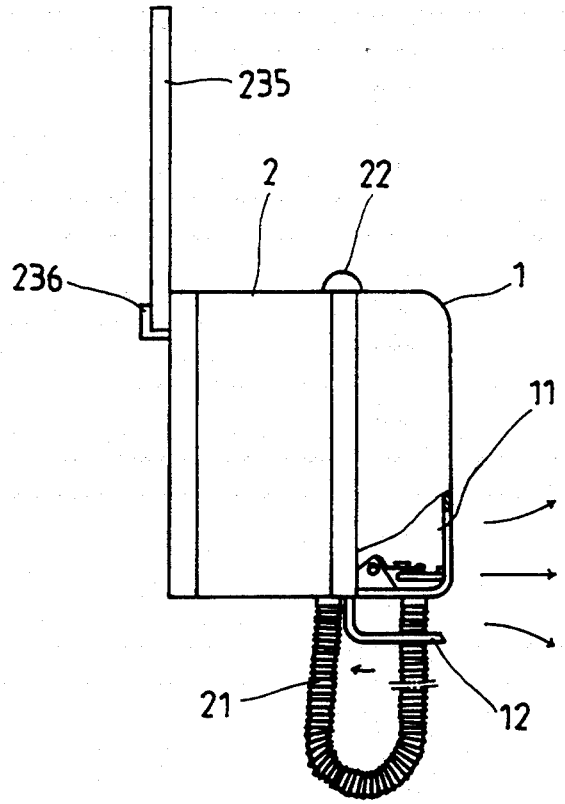
FIG. 8 is similar to FIG. 7 but showing currents of hot air driven out of the front opening of the front cover forward.

Referring to FIGS. 1 through 6, a fully clad electric PTC (positive-temperature-coefficient) heater 32 is mounted on the air output port 31 of a blast fan 3 so that hot currents of air are produced when the blast fan 3 and the fully clad electric PTC heater 32 are turned on. An air duct 33 with a shutter 331 is connected to the air output port 31 of the blast fan 3. The blast fan 3 is installed in a housing 2 and covered by a front cover 1. The front cover 1 has an opening 11, and an air hole 111 communicated with the opening 11 and connected to the air output port 31 of the blast fan 3. A flow guide 12 is mounted on the opening 11 and moved vertically by a control knob 14 to guide the flow of hot air from the air duct 33 downward or forward (see also FIGS. 7 and 8). When the output flow of hot air is guided downward, it is used to dry wet towels on the towel rack 13, which is mounted on the front cover 1. When the output flow of hot air is guided forward, it can be used to warm the temperature of the bathroom or lavatory and to eliminate mist from mirrors. The front cover 1 has a second air hole 112 connected to the air output port 31 of the blast fan 3 and controlled by the shutter 331. A hot air hose 21 is provided, having one end connected to the the second air hole 112 and an opposite end coupled with an air-flow nozzle 22 for blow-drying the hair. A vertical sliding way 234 is made on the housing 2 at one side near the front cover 1. A sliding hanger 23 is moved in the vertical sliding way 234 and coupled to a pull rope 2312 for holding the air-flow nozzle 22. The pull rope 2312 has one end fastened to the sliding hanger 23, and an opposite end inserted through a series of guide pulleys 233 and then connected to the shutter 331. When the air-flow nozzle 22 is removed from the sliding hanger 23, the sliding hanger 23 is pulled upwards by the pull rope 231, and the shutter 331 is moved in one direction to let the hot flow of air be driven out of the second air hole 112 to the hot air hose 21 for drying the hair (see FIGS. 4 and 6). When the air-flow nozzle 22 is hung on the sliding hanger 23, the sliding hanger 23 is forced downward along the vertical sliding way 234, and the shutter 331 is moved in the reversed direction to let the hot flow of air be driven out of the first air hole 111 (see FIGS. 3 and 5).

Figure 9:
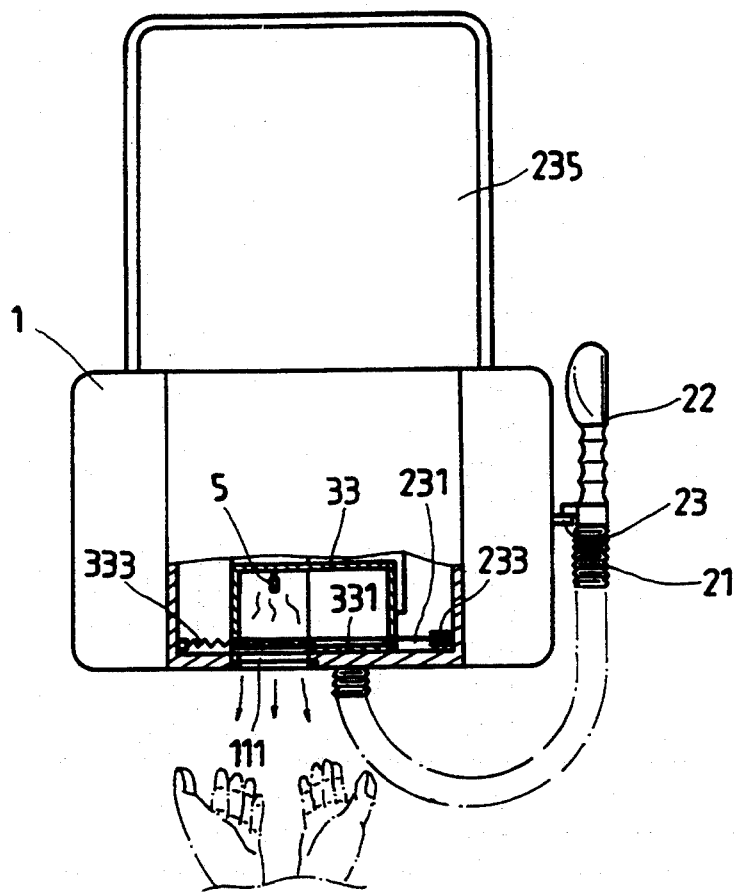
FIG. 9 is a front view in section of the multipurpose electric dryer of FIG. 1, showing currents of hot air driven out of the front opening of the front cover to dry the hands.
Figure 10:
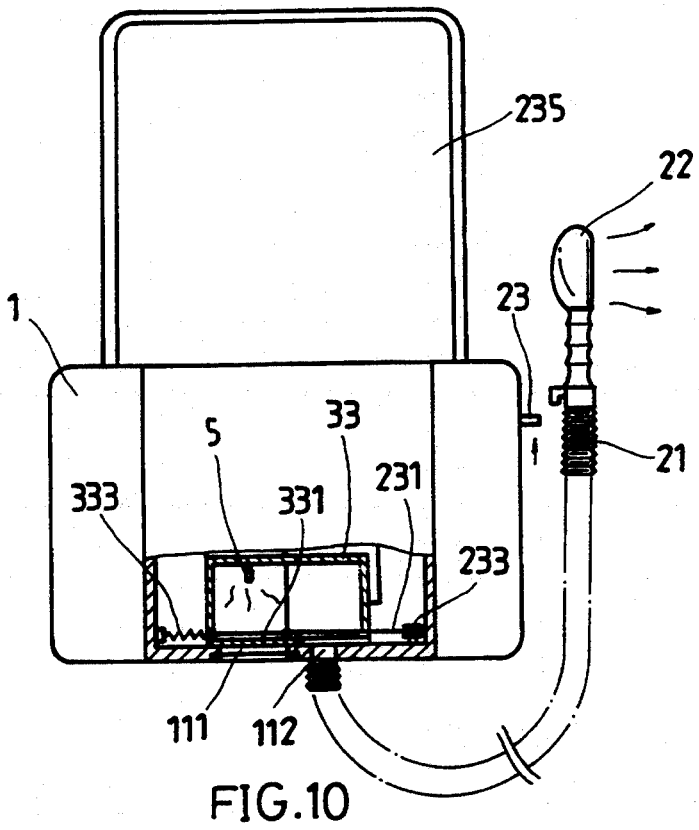
FIG. 10 is another front view in section of the multipurpose electric dryer of FIG. 1, showing currents of hot air driven out of the air-flow nozzle.

Referring to FIGS. 9 and 10, the shutter 331 has one end fastened to a fixed spring 333 and an opposite end connected to the pull rope 231. When the air-flow nozzle 22 is removed from the sliding hanger 23, the spring 333 automatically returns to its former shape, causing the shutter 331 moved leftward to close the first air hole 111 and open the second air hole 112 for letting the flow of hot air be driven out of the hot air hose 21 through the air-flow nozzle 22 for drying the hair. When the air-flow nozzle 22 is hung on the sliding hanger 23, the sliding hanger 23 is forced downward to pull the pull rope 231, causing the shutter 331 moved rightward to close the second air hole 112 and open the first air hole 111 for letting the flow of hot air be driven out of the opening 11 for drying the hand, the towels, etc. Furthermore, a detector 5 is installed in the opening 11 and controlled by a control circuit 4 to automatically turn on the blast fan 3 and the fully clad electric PTC heater 32 when the hands 6 are put to the effective detecting range of the detector 5 or when the shutter 331 is moved to open the second air hole 112. Furthermore, the housing 2 has lugs 236 for hanging a mirror 235, and a top recess 232 for holding things (see also FIGS. 1 and 2.

While only one embodiment of the present invention has been shown and described, it will be understood that various modifications and changes could be made without departing from the spirit and scope of the invention.

What is claimed is:

1. A multipurpose electric dryer comprising:

a housing covered with a front cover, said front cover comprising a front opening, a flow guide moved in said front opening to let a flow of hot air be driven out of said front opening forward or downward, a vertical sliding way at one side, a first air hole communicated with said front opening, and a second air hole;

a blast fan installed in said housing and having an air output port coupled with a fully clad electric positive-temperature-coefficient heater and connected to said first and second air holes;

a towel rack mounted on said front cover below said front opening for holding towels;

a sliding hanger moved in said vertical sliding way;

a hot air hose having one end fixedly connected to said second air hole and an opposite end extended out of said front cover and coupled with an air-flow nozzle;

a shutter linked to said sliding hanger by a pull rope and guide pulley set and moved with said sliding hanger to alternatively open said first and second air holes, permitting hot air from said blast fan and said fully clad electric positive-temperature-coefficient heater be driven out of said front opening on said front cover or said hot air hose;

reversible means mounted on said front cover to pull said shutter away from said second air hole; and wherein when said air-flow nozzle is hung on said sliding hanger, said sliding hanger is forced downward to pull said shutter rightward, causing said shutter to open said first air hole and close said second air hole; when said air-flow nozzle it removed from said sliding hanger, said reversible means pulls said shutter leftwards to its former position to close said first air hole and open said second air hole.

2. The multipurpose electric dryer of claim 1 wherein said reversible means is a spring.

3. The multipurpose electric dryer of claim 1 wherein said housing comprises two lugs bilaterally raised from a back side thereof, and a mirror mounted on said lugs.

4. The multipurpose electric dryer of claim 1 wherein said housing has a top recess for holding things.

* * * * *